US010694794B2

(12) United States Patent
Komperda

(10) Patent No.: US 10,694,794 B2
(45) Date of Patent: Jun. 30, 2020

(54) SELF-DEFENSE GLOVE

(71) Applicant: George Komperda, Medinah, IL (US)

(72) Inventor: George Komperda, Medinah, IL (US)

( * ) Notice: Subject to any disclaimer, the term of this patent is extended or adjusted under 35 U.S.C. 154(b) by 0 days.

(21) Appl. No.: 15/901,544

(22) Filed: Feb. 21, 2018

(65) Prior Publication Data

US 2018/0177252 A1 Jun. 28, 2018

Related U.S. Application Data

(63) Continuation-in-part of application No. 15/154,621, filed on May 13, 2016, now Pat. No. 9,927,213.

(60) Provisional application No. 62/160,843, filed on May 13, 2015.

(51) Int. Cl.

| | |
|---|---|
| ***F41H 9/10*** | (2006.01) |
| ***A41D 19/00*** | (2006.01) |
| ***A41D 19/015*** | (2006.01) |

(52) U.S. Cl.

CPC ..... *A41D 19/0037* (2013.01); *A41D 19/0024* (2013.01); *A41D 19/0031* (2013.01); *A41D 19/0157* (2013.01); *F41H 9/10* (2013.01); *A41D 19/0013* (2013.01); *A41D 19/01594* (2013.01)

(58) Field of Classification Search

CPC ..... A41D 19/0037; A41D 19/0024; A41D 19/0031; A41D 19/0157; A41D 19/0013; A41D 19/01594; F41H 9/10; F41H 9/04; F41H 9/00; B05F 7/1413; B05F 7/2402

USPC ..... 222/175, 192; 2/160, 163

See application file for complete search history.

(56) References Cited

U.S. PATENT DOCUMENTS

| | | | | |
|---|---|---|---|---|
| 4,504,980 | A | 3/1985 | Butcher | |
| 4,768,681 | A * | 9/1988 | Dean | F41B 9/0031 2/160 |
| 4,848,246 | A | 7/1989 | Rosen | |
| 5,088,121 | A | 2/1992 | Wallace | |
| 5,289,164 | A | 2/1994 | Novak | |
| 5,503,304 | A * | 4/1996 | Keller | F41H 9/10 222/175 |
| 5,538,164 | A | 7/1996 | Rivas | |
| 5,673,436 | A | 10/1997 | Piper | |
| 5,943,701 | A | 8/1999 | Seats | |
| 6,966,462 | B1 | 11/2005 | Torrence | |
| 7,477,504 | B1 * | 1/2009 | Delida | F41H 13/0018 361/230 |

(Continued)

*Primary Examiner* — Paul R Durand
*Assistant Examiner* — Robert Nichols, II
(74) *Attorney, Agent, or Firm* — Boudwin Intellectual Property; Daniel Boudwin

(57) ABSTRACT

A self-defense glove. The self-defense glove includes a body having a palm portion, a rear portion, and a plurality of finger openings, each of the finger openings configured to receive a finger therethrough. A pocket configured to receive a spray-deterrent canister such as a pepper spray canister is disposed on the rear portion. A control is disposed on the palm portion. When activated by a user, the control is configured to actuate the pepper spray canister, causing pepper spray to be emitted therefrom. The control is also configured to actuate at least one electrode sending an electrical current therethrough. The user may aim the pepper spray canister in the direction of an attacker and activate the control in order to incapacitate the attacker with the pepper spray. The rear portion further includes a warning label and a light thereon in order to deter would-be assailants from initiating a confrontation.

10 Claims, 3 Drawing Sheets

(56) References Cited

U.S. PATENT DOCUMENTS

| | | | | |
|---|---|---|---|---|
| 8,154,844 | B2 | 4/2012 | Brown | |
| 2003/0229931 | A1* | 12/2003 | Smedi | A41D 19/0051 2/159 |
| 2008/0247679 | A1* | 10/2008 | Dayton | B65D 33/25 383/33 |

* cited by examiner

SELF-DEFENSE GLOVE

CROSS REFERENCE TO RELATED APPLICATIONS

This application claims the benefit of U.S. Non-Provisional application Ser. No. 15/154,621 filed on May 13, 2016 which claims priority to U.S. Provisional Application No. 62/160,843 filed on May 13, 2015. The above identified patent application is herein incorporated by reference in its entirety to provide continuity of disclosure.

BACKGROUND OF THE INVENTION

The present invention relates to self-defense devices. More specifically, the present invention provides a self-defense glove having a pepper spray canister, at least one electrode configured to deliver an electrical shock and a control on the palm portion configured to actuate the pepper spray canister and electrode.

Many individuals recognize that there is a risk of being attacked in public places. Particularly when walking alone at night, there is a risk that an individual will be attacked by a mugger or other assailant. Individuals often carry various means of protection on their persons in order to provide self-defense in case of an attack or to deter a suspected assailant from attacking. Some individuals carry self-defense weapons such as batons, stun guns, firearms, knives, and the like. One drawback to these devices is that they require an individual be close to the attacker for them to be affective, which places the individual in danger. Additionally, some of these devices, particularly knives and firearms, are often deadly, and individuals may not wish to inflict deadly force on an attacker.

A more effective self-defense device exists that allows users to deter attackers from a distance using an irritating pepper spray aimed at the attacker's face. The pepper spray irritates the eyes, mouth, and nostrils of the assailant, which causes them to desist or become incapacitated due to the discomfort. Pepper spray is normally contained in a spray canister. Typical pepper spray canisters are carried by a user and have a trigger that the user can depress with their finger in order to dispense pepper spray from the canister.

Pepper spray is often very effective at repelling assailants and allows individuals to do so from a distance. However, in order for a pepper spray canister to be effective at deterring a surprise attack, the individual must already be holding the pepper spray canister before the attack occurs. The pepper spray canister therefore occupies the individual's hand and prevents the individual from using their hand for other tasks. Additionally, pepper spray canisters do not have prominent warning labels to notify would-be attackers that the individual is armed with a self-defense device. Such a warning decreases the likelihood the individual will be attacked in the first place, providing additional pre-emptive self-defense. Therefore, there is need for a self-defense device that allows users to utilize a pepper spray canister while still allowing the individual use of both hands, wherein the same device displays a warning to would-be assailants in order to deter attacks.

Furthermore, a self-defense glove comprises at least one electrode may be desirable. An electrode configured to deliver an electrical shock to a target may be useful to a wearer if they are attacked and need a method of defense for themselves at a close range.

In light of existing self-defense devices in the prior art, it is submitted that the present invention substantially diverges in design elements from the prior art and consequently it is clear that there is a need in the art for an improvement to existing self-defense devices. In this regard the instant invention substantially fulfills these needs.

SUMMARY OF THE INVENTION

In view of the foregoing disadvantages inherent in the known types of self-defense devices now present in the prior art, the present invention provides a self-defense glove wherein the same can be utilized for providing convenience for the user when carrying pepper spray for self-defense.

The self-defense glove includes a body having a palm portion, a rear portion, and a plurality of finger openings, each of the finger openings configured to receive a finger therethrough. A pocket is disposed on the rear portion, wherein the pocket is configured to receive a spray canister having an actuator. A control is disposed on the palm portion of the body. The control is in operative communication with the actuator of the spray canister via a control circuit. The control is configured to cause pepper spray to be emitted from the spray canister when activated.

One object of the present invention is to provide a self-defense glove having all of the advantages of existing self-defense devices and none of the disadvantages.

Another object of the present invention is to provide a self-defense glove having a warning symbol on an exterior surface thereof in order to deter would-be assailants.

A further object of the present invention is to provide a self-defense glove having a light on an exterior surface thereof in order to illuminate the wearer's surroundings and provide additional safety to the wearer.

Yet another object of the present invention is to provide a self-defense glove having at least one electrode embedded therein wherein the electrode is configured to deliver an electrical shock to a target.

Other objects, features, and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
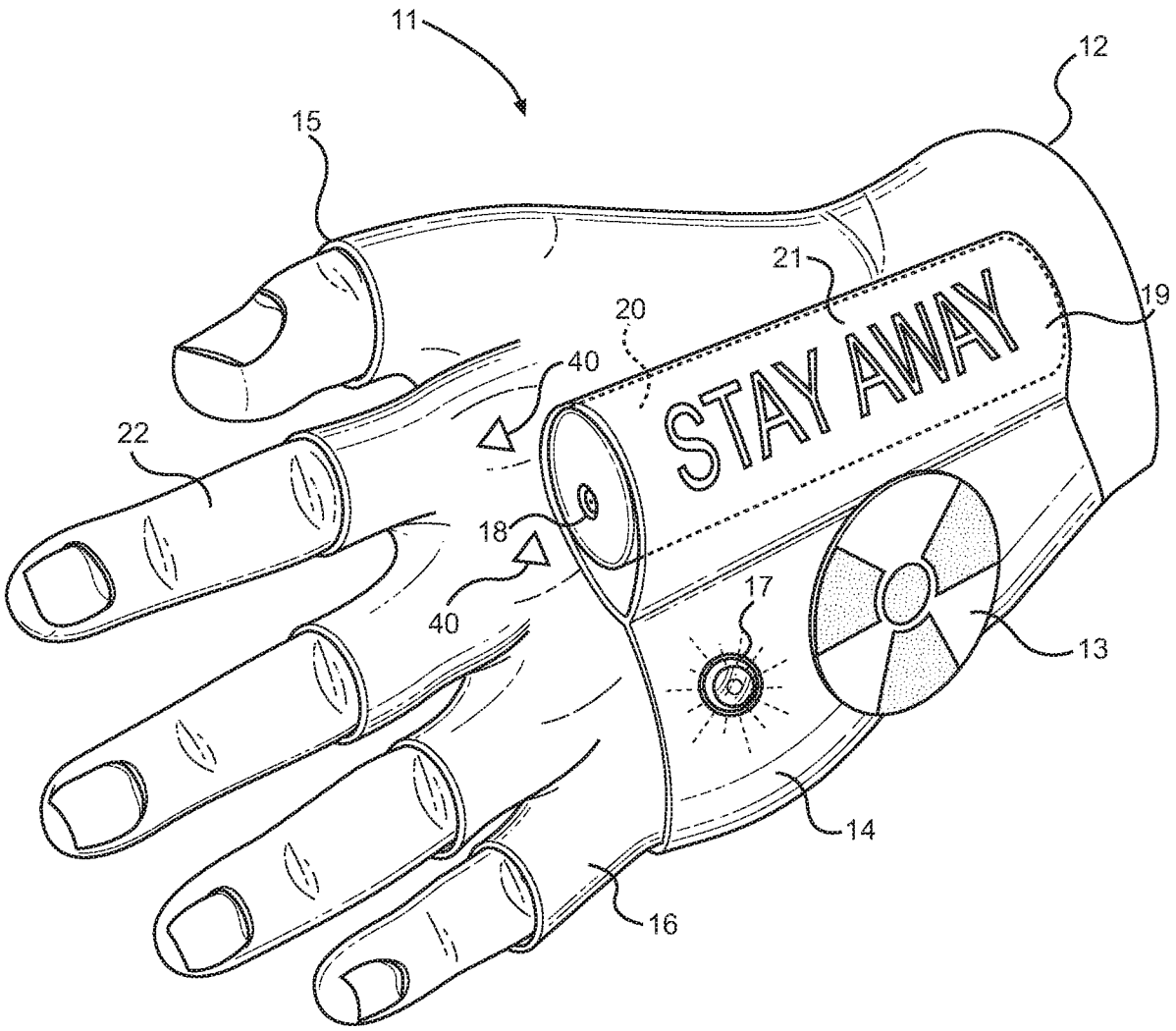
FIG. 1 shows a perspective view of the rear portion of a self-defense glove according to the present invention.

Reference is made herein to the attached drawings. Like reference numerals are used throughout the drawings to depict like or similar elements of the self-defense glove. For the purposes of presenting a brief and clear description of the present invention, the preferred embodiment will be discussed as used for providing self-defense capabilities to a wearer. The figures are intended for representative purposes only and should not be considered to be limiting in any respect.

Referring now to FIG. 1, there is shown a perspective view of the rear portion of a self-defense glove according to the present invention. The self-defense glove 11 generally comprises a body having a rear side 14, a palm side (not visible), and an opening 12 for receiving a hand therethrough. Finger openings 16 are disposed on the body and are each configured to accept a finger 22 therethrough. The individual finger openings 16 are preferably each sized to properly accommodate a particular corresponding finger on the hand. In the illustrated embodiment, the finger openings 16 include an open upper end 15, such that the tips of the wearer's fingers 22 extend therethrough. In alternate embodiments, the upper end 15 is closed such that the tips of the wearer's fingers 22 contact an interior surface of the upper end 15. Additionally, the self-defense glove 11 may have finger openings 16 configured for either right-hand or left-hand use.

The self-defense glove 11 further comprises a pocket 19 disposed on the rear side 14. The pocket 19 is configured to receive a pepper spray canister 20 therein. In the illustrated embodiment, the pocket 19 includes a circular cross-section in order to accommodate a cylindrical spray canister 20, however, other shapes and configurations of the pocket 19 may be utilized. The pepper spray canister 20 includes an actuator 18 thereon. The actuator 18 is configured to dispense the contents of the pepper spray canister 20 when actuated via a control disposed on the palm side of the self-defense glove (not visible). The direction of spray of the pepper spray canister 20 is preferably in the direction of the fingers 22 of the wearer, allowing the wearer to easily aim the pepper spray canister 20 at an attacker.

A warning symbol 13 is disposed on the rear side 14. The warning symbol 13 is preferably one that notifies others that the wearer of the self-defense glove 11 is armed with a self-defense device. For example, the warning symbol 13 may be a radio-active symbol, which is a universal indicator of danger. In the illustrated embodiment, the self-defense glove 11 further comprises a secondary warning 21 prompting unwanted individuals to stay away from the wearer of the self-defense glove 11.

The self-defense glove 11 additionally comprises a light 17 such as an LED disposed on the rear side 14. The light 17 may be oriented in any desired direction when the user orients the self-defense glove 11. The light 17 may be controlled via the same control as the actuator 18 of the pepper spray canister 20. Alternatively, the light 17 may be controlled via a dedicated light control disposed on either the rear side 14 or the palm side of the self-defense glove.

Furthermore, the self-defense glove 11 additionally comprises at least one electrode 40. The electrode 40 is configured to release an electrical current therethrough, so as to deliver an electrical shock to a target. The electrode 40 is configured to be exposed when a fist is formed by a wearer of the self-defense glove 11. The electrode 40 is operably attached to the actuator 18 such as to activate an electrical current through the electrode when the control is engaged and the actuator is actuated. A power source 41 is operably attached to the electrode so as to generate an electrical current when the actuator is actuated.

Figure 2:
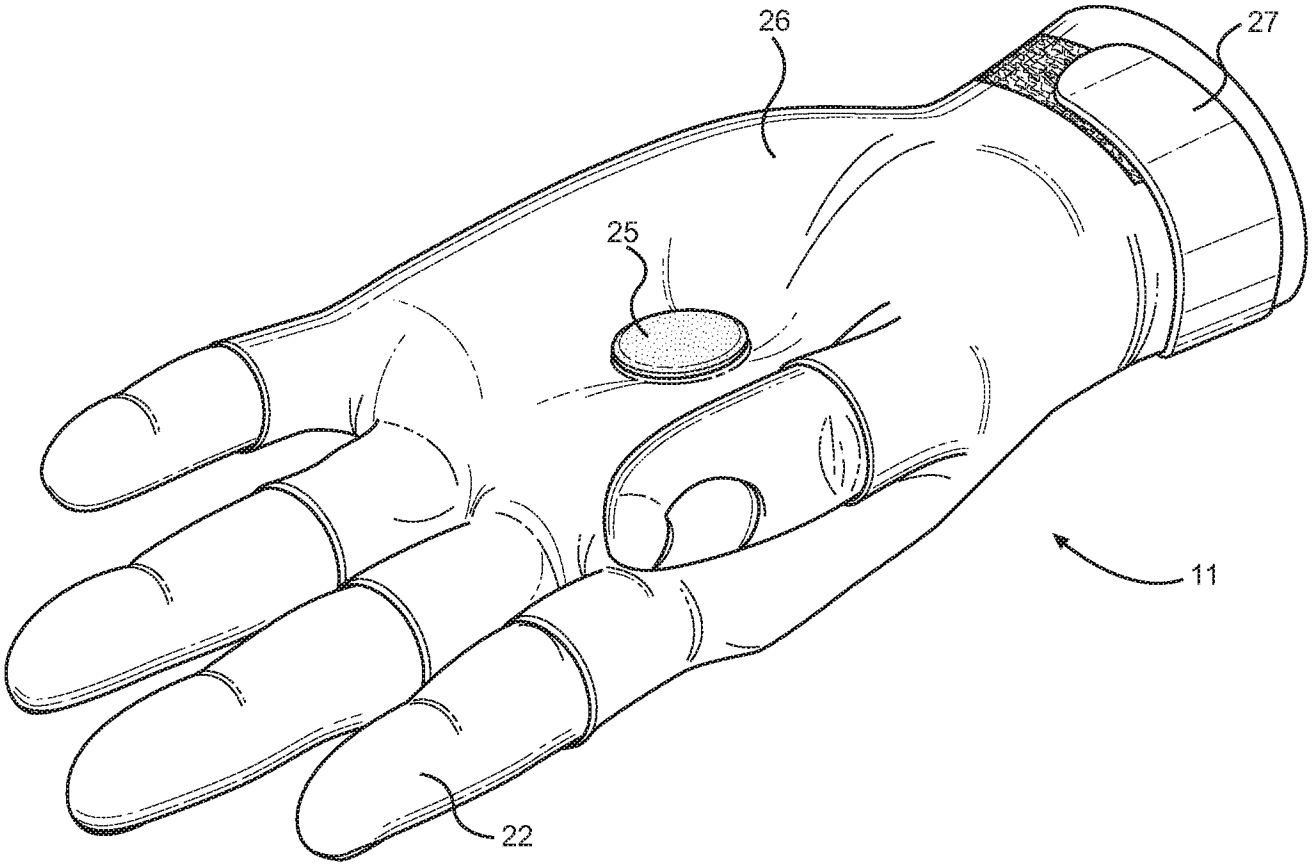
FIG. 2 shows a perspective view of the palm portion of a self-defense glove according to the present invention.

Referring now to FIG. 2, there is shown a perspective view of the palm portion of a self-defense glove according to the present invention. The palm side 26 of the self-defense glove includes a control 25 thereon. In the illustrated embodiment, the control 25 is a button, however a switch or other type of control may be utilized. The control 25 is configured to cause the actuator 18 to dispense the contents of the pepper spray canister 20 when the control 25 is activated. The wearer may activate the control 25 by applying pressure to the control 25 via any one of their fingers 22. In a preferred embodiment, the control 25 is positioned on the palm side 26 in a location that allows a user to easily activate the control 25 with a particular finger 22 such as the thumb or index finger.

In the illustrated embodiment, the self-defense glove 11 further comprises a fastener 27 that is utilized to tightly secure the self-defense glove 11 to a user's hand. The fastener 27 may include buckles, snaps, hook and loop material, or any other suitable fastener 27 capable of securing the self-defense glove 11 to the wearer's hand. Alternatively, the self-defense glove 11 may be composed of an elastic material that allows the self-defense glove 11 to stretch and fit snuggly over a wearer's hand. The fastener 27 may either be disposed on the palm side 26 or the front side of the self-defense glove 11.

Figure 3:
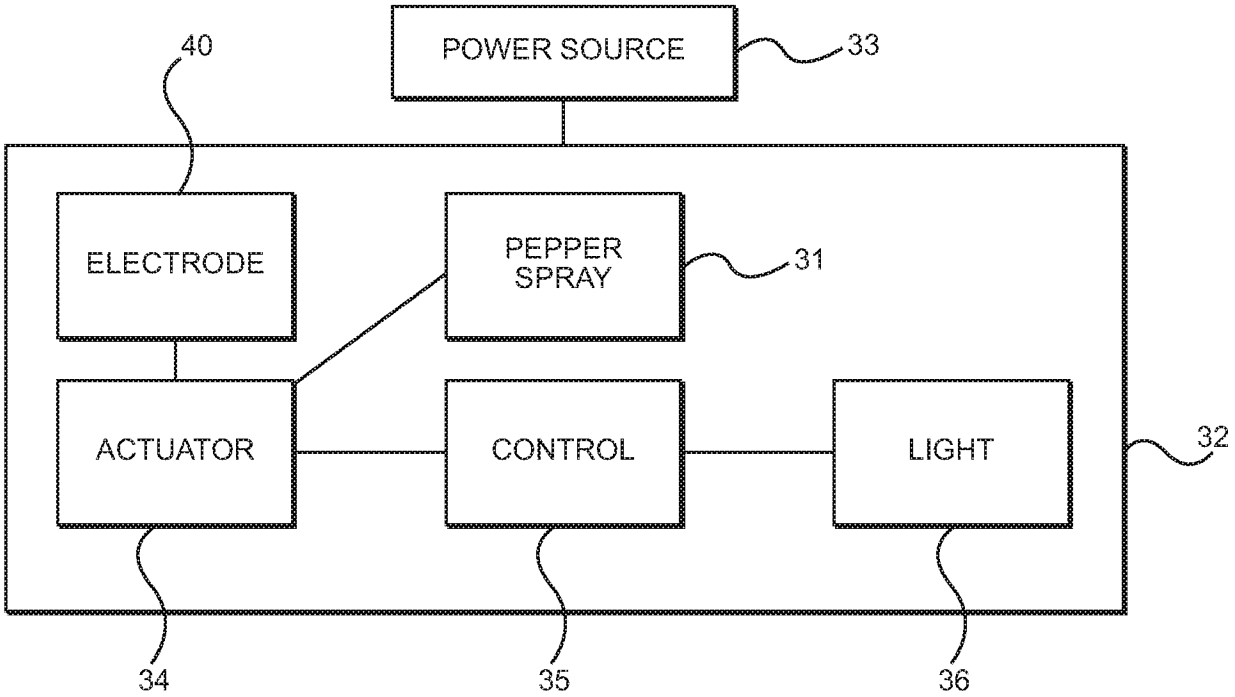
FIG. 3 shows a diagram of the components of a self-defense glove according to the present invention.

Referring now to FIG. 3, there is shown a diagram of the components of a self-defense according to the present invention. The self-defense glove includes a power source 33 which powers the components of the self-defense glove. In one embodiment, the power source 33 is either a single use battery or a rechargeable battery. Some embodiments include a removable battery while other embodiments may include a charging port.

The power source 33 is in operative communication with the control circuit 32 of the self-defense glove and provides electrical power to the various components of the self-defense glove. The control circuit 32 is configured to enact the various functions of the self-defense glove. The control circuit 32 includes a control 35 such as a button or level disposed on the palm side of the self-defense glove. The control circuit further includes a light 36 and an actuator 34 of a pepper spray canister. The control 35 is in operative communication with the actuator 34 of the pepper spray canister and the light 36. When the control 35 is activated, for example, via depression of the button, the control is configured to cause the actuator 34 to actuate, which in turn dispenses the contents of the pepper spray canister. In one embodiment, the light 36 is configured to be controlled via the control 35. In an alternate embodiment, there may be a second control 35 that is configured to control the light 36. The light 36 may maintain a variety of illumination settings, such as constantly lit, strobing, or off.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A self-defense glove, comprising:

a body comprising a palm portion, a rear portion, and a plurality of finger openings, each of the finger openings configured to receive a finger therethrough;

a pocket comprising a circular cross-section, an open front end, and a closed rear end disposed on the rear portion of the pocket, the pocket configured to receive a spray canister having an actuator therein;

wherein the open front end is configured to receive the spray canister therethrough, and dispense pepper spray from the spray canister through the open front end;

the pocket positioned entirely between a thumb opening and a pinky opening of the plurality of finger openings;

a control disposed on the palm portion;

a first warning marker disposed on the rear portion of the body;

a secondary warning marker disposed entirely on the pocket;

wherein the control is in operative communication with the actuator of the spray canister via a control circuit;

at least one electrode configured to extend from the rear portion over a knuckle of a user when a first of a wearer is formed;

wherein the electrode is in operative communication with the actuator;

wherein the actuator is in operable communication with the control;

wherein the control is configured to cause pepper spray to be emitted from the spray canister when activated and is configured to cause an electric current to flow through at least one electrode.

2. The self-defense glove of claim 1, wherein the first warning marker comprises a radio-active symbol.

3. The self-defense glove of claim 1, wherein the plurality of finger openings comprise an open upper end such that a tip of the finger extends therethrough.

4. The self-defense glove of claim 1, wherein the plurality of finger openings comprise a closed upper end such that a tip of the finger contacts an interior portion of the closed upper end.

5. The self-defense glove of claim 1, further comprising a light disposed on an exterior surface thereof.

6. The self-defense glove of claim 5, wherein the light is configured to be activated upon activation of the control.

7. The self-defense glove of claim 1, further comprising a power source disposed therein, wherein the power source is in operative communication with each of the control, the control circuit, and the actuator of the spray canister.

8. The self-defense glove of claim 1, wherein the body is composed of an elastic material.

9. The self-defense glove of claim 1, further comprising a fastener configured to secure the glove to a hand.

10. The self-defense glove of claim 9, wherein the fastener comprises hook and loop material.

* * * * *